US006357415B1

(12) United States Patent
Mori

(10) Patent No.: US 6,357,415 B1
(45) Date of Patent: Mar. 19, 2002

(54) FUEL SHUT-OFF DEVICE FOR INTERNAL COMBUSTION ENGINE

(75) Inventor: Katsumi Mori, Chiryu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/599,577

(22) Filed: Jun. 23, 2000

(30) Foreign Application Priority Data

Aug. 5, 1999 (JP) ..... 11-222445

(51) Int. Cl.[7] ..... F02B 77/00

(52) U.S. Cl. ..... 123/198 DB; 123/510; 137/493.6

(58) Field of Search ..... 123/198 D, 198 B, 123/446, 510, 456; 137/493.6, 498, 504

(56) References Cited

U.S. PATENT DOCUMENTS 2,307,949 A * 1/1943 Phillips ..... 137/498
2,809,658 A * 10/1957 Frantz et al. ..... 137/498
3,958,596 A * 5/1976 Garrard ..... 137/504
4,319,604 A * 3/1982 Bird ..... 137/498
4,539,959 A * 9/1985 Williams ..... 123/456
4,589,393 A 5/1986 Jourde et al.
5,215,113 A * 6/1993 Terry ..... 137/460
5,511,528 A 4/1996 Iwanaga et al.
5,551,476 A * 9/1996 McGinnis ..... 137/517
5,634,489 A * 6/1997 Tschauner ..... 137/493.6
5,692,476 A 12/1997 Egler et al.

* cited by examiner

*Primary Examiner*—Carl S. Miller
(74) *Attorney, Agent, or Firm*—Nixon & Vanderhye P.C.

(57) ABSTRACT

A fuel shut-off safety device is mounted in a fuel injection system for an internal combustion engine. The fuel shut-off safety device includes a cylindrical body having a fuel passage and a valve seat, a piston disposed to slide in the fuel passage, a valve body to shut off the fuel passage when it is seated on the valve seat, a center bore connected to the fuel inlet, and an aperture connecting the center bore and the fuel passage, and a compression coil spring for biasing the piston to unseat the valve body from the valve seat.

4 Claims, 3 Drawing Sheets

FUEL SHUT-OFF DEVICE FOR INTERNAL COMBUSTION ENGINE

CROSS REFERENCE TO RELATED APPLICATION

The present application is based on and claims priority from Japanese Patent Application Hei 11-222445 filed on Aug. 5, 1999, the contents of which are incorporated herein by reference.

BACKGROUND OF THE INVENTION

1. Field of the Invention

The present invention relates to a fuel shut-off safety device to be mounted in a fuel injection system for an internal combustion engine.

2. Description of the Related Art

In a pressure accumulation type fuel injection system, high pressure fuel is accumulated into a common-rail, a surge tank, or a pressure-accumulation pipe by a high pressure pump. Usually, a fuel shut-off device is provided in such a system to shut off fuel for safety if an abnormal operation of a fuel injection valve, such as excessive fuel discharge, is detected. U.S. Pat. No. 5,692,476 or PCT Application Hei 9-512325 discloses such a fuel shut-off device.

However, such a fuel shut-off device is expensive because it is made up of numerous complicated parts. Moreover, for such a fuel shut-off device it is difficult to change the operation characteristics so that it can be applied to a different engine.

SUMMARY OF THE INVENTION

A main object of the invention is to provide a simple, reliable and inexpensive safety device to be mounted in a fuel injection system for an internal combustion engine.

Another object of the invention is to provide a fuel shut-off safety device in which the operation conditions can be changed easily.

According to the invention, a fuel shut-off device for an internal combustion engine includes a cylindrical body having a fuel passage and a valve seat, a piston disposed to axially slide in the fuel passage and having a valve body to shut off the fuel passage when it is seated on the valve seat, and biasing means for biasing the piston to unseat valve body from the valve seat. The piston has a center bore connected to a fuel inlet of the cylindrical body and an aperture connecting the center bore and the fuel passage. Therefore, an excessive amount of fuel can be prevented from flowing into the fuel injectors by a simple and inexpensive fuel shut-off device.

In the fuel shut-off device, the biasing means may be a coil spring disposed around the valve body.

The fuel shut-off device may further include a gasket having a flange portion in contact with the cylindrical body at the fuel inlet and two sleeve portions having different lengths longitudinally extending from the flange portion in opposite directions so that any one of the sleeve portions can be fitted in the fuel passage.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

Preferred embodiments of the invention are described with reference to the appended drawings.

(First Embodiment)

A fuel shut-off device according to a first embodiment of the invention is described with reference to FIGS. 1 and 2.

Figure 2:
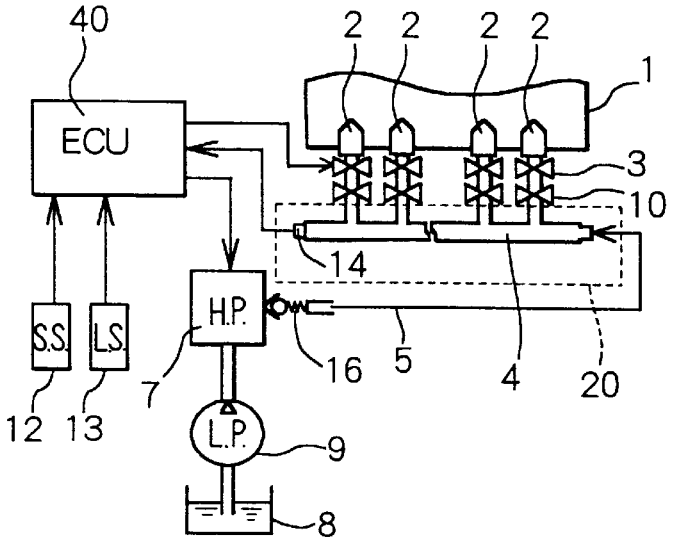
FIG. 2 is a schematic diagram illustrating a fuel injection system for an internal combustion engine having the fuel shut-off device mounted therein.

As shown in FIG. 2, a plurality of fuel injectors 2 are respectively mounted in a plurality of cylinders of a diesel engine 1. Each injector 2 is controlled by injection control electromagnetic valve 3 to open or close, thereby controlling fuel injection. Each injector 2 is connected to accumulation chamber 4 of common rail 20. Fuel is injected by injectors 2 from accumulation chamber 4 to respective cylinders of engine 1 when electromagnetic valves 3 open. High pressure fuel pump 7 is connected to accumulation chamber 4 to continuously supply high pressure fuel thereto through fuel supply pipe 5 and fuel delivery valve 16. High pressure fuel pump 7 is supplied with fuel by low pressure fuel pump 9 from fuel tank 8.

ECU 40 controls the fuel injection system according to an engine speed detected by engine speed sensor 12 and an engine load detected by engine load sensor 13. ECU 40 sends control signals to respective electromagnetic valves 3 to provide suitable injection timing and fuel quantity. ECU 40 also sends a control signal to high pressure fuel pump 7 so that the injection pressure can be controlled according to the engine speed and engine load.

Fuel shut-off device 10 is mounted in common rail 20. As shown in FIG. 1, fuel shut-off device 10 is comprised of cylindrical body 6, piston 30 and compression coil spring 34.

Cylindrical body 6 has fuel passage 61 formed at the center thereof and fuel outlet 68 at the upper end thereof. Piston 30 is inserted into fuel passage 61 with coil spring 34. Gasket 36 is fixed to the lower end of cylindrical body 6. Gasket 36 has fuel inlet 361. Snap ring 50 is mounted at an upstream portion of fuel passage 61.

Piston 30 has cylindrical slide portion 31 which can slide along fuel passage 61, and cylindrical valve body portion 32 which protrudes into the downstream portion of fuel passage 61 from slide portion 31. Valve body portion 32 has a smaller outside diameter than slide portion 31 so that shoulder portion 35 can be formed between slide portion 31 and valve body portion 32. Slide portion 31 has center bore 311, as a fuel passage, connected to fuel inlet 361 of gasket 36. Restriction aperture 33 is transversely formed at valve body portion 32 to connect center bore 311 and fuel passage 61 between valve seat 69 and slide portion 31.

Compression coil spring 34 has upper end 341 which is supported by shoulder portion 62 around valve seat 69 and lower end 342 which is supported by shoulder 35 of slide portion 31. Compression coil spring 34 biases piston 30 to unseat the same from valve seat 69. In other words, compression coil spring 34 biases piston 30 against gasket 36 when fuel flow is not present. Because compression coil spring 34 is disposed around valve body 32, fuel shut-off device 10 can be made short and compact.

Valve body 32 has tapered portion 321, which closes fuel passage 61 completely when it is seated on valve seat 69.

When high pressure fuel is supplied to fuel inlet 361 from pressure accumulation chamber 4, the fuel is thereafter supplied through center bore 311, restriction aperture 33, fuel passage 61, and outlet 68 to one of injectors 2. When the fuel flowing through restriction aperture 33 increases, a pressure difference is generated across restriction aperture 33 between center bore 311 and fuel passage 61. If the pressure difference is smaller than the spring force of compression coil spring 34, piston 30 is positioned as shown in FIG. 1.

If the fuel flowing through restriction aperture 33 further increases and the pressure difference becomes larger than the spring force, piston 30 moves upward and stays at a position where the pressure difference and the spring force balance with each other.

If the fuel further increases, the pressure difference becomes large enough to seat valve body 32 of piston 30 on valve seat 69. As a result, the high pressure fuel is not supplied to injector 2. This prevents abnormal operation of injector 2 due to an excessive fuel supply.

Figure 1:
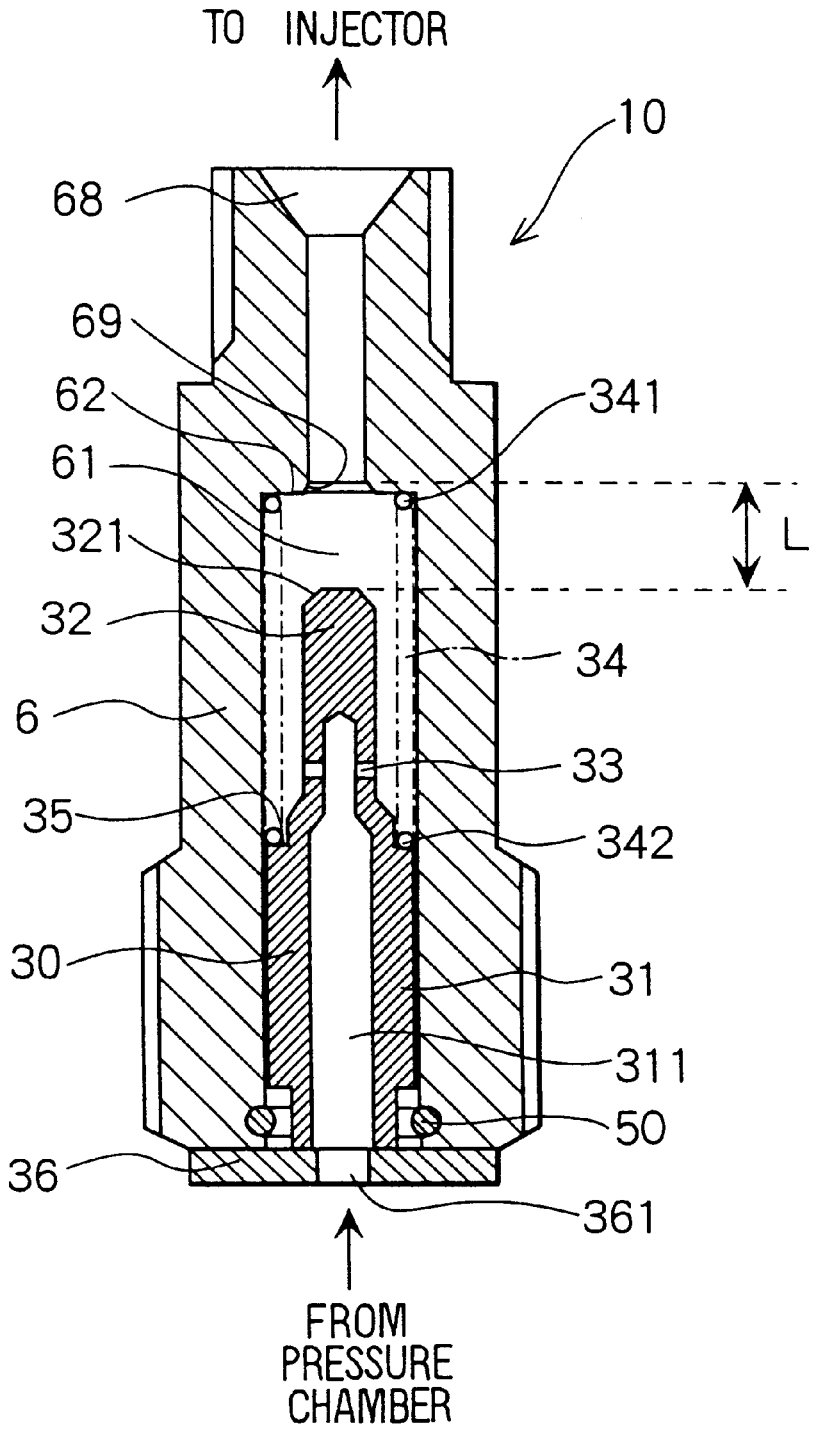
FIG. 1 is a longitudinal cross-sectional side view of a fuel shut-off device according to a first embodiment of the invention.

It is noted that the maximum quantity of fuel to be supplied to the injector is controlled by the moving distance L of piston 30 as indicated in FIG. 1.

(Second Embodiment)

A fuel shut-off device according to a second embodiment of the invention is described with reference to FIGS. 3–5. In the drawing, the same reference numeral corresponds to the same or substantially the same part or portion as the first embodiment.

Figure 3:
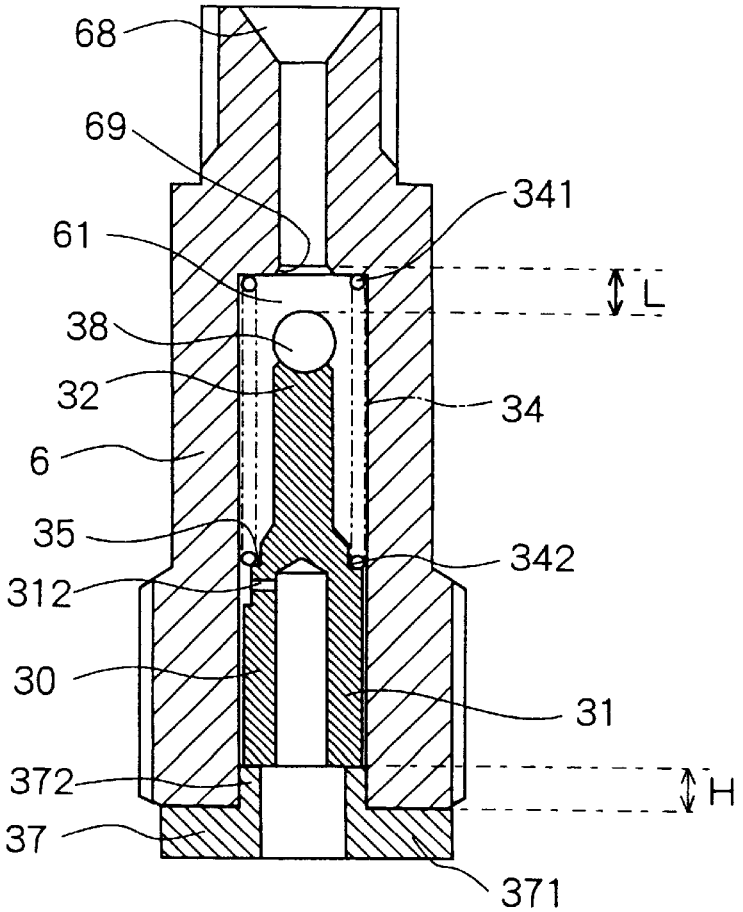
FIG. 3 is a longitudinal cross-sectional side view of a fuel shut-off device according to a second embodiment of the invention.
Figure 4:
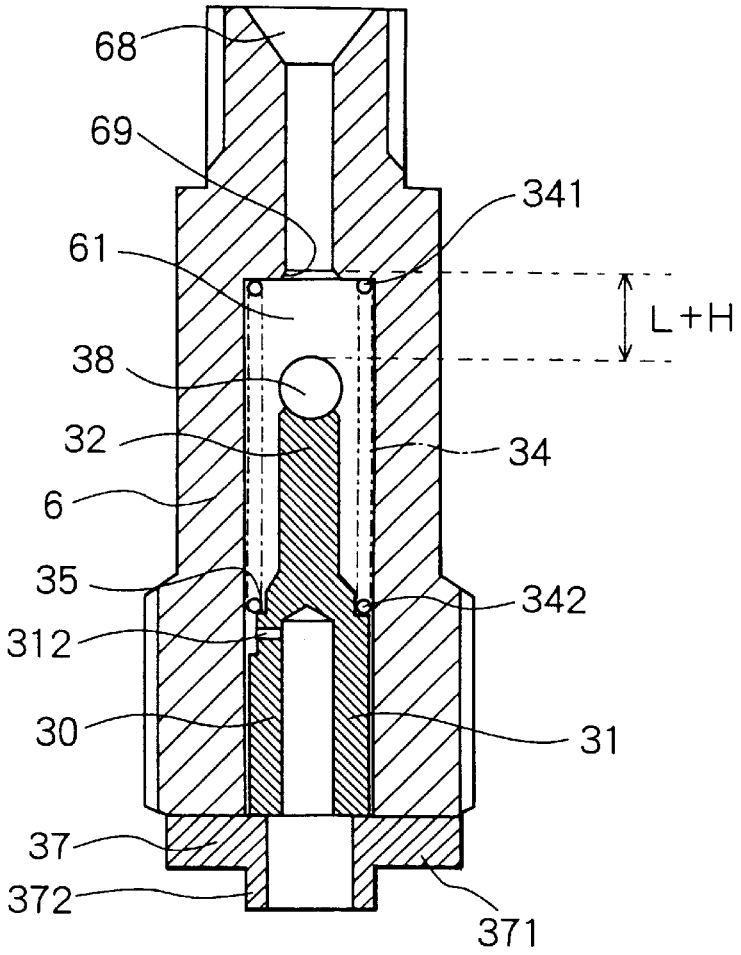
FIG. 4 is a longitudinal cross-sectional side view of the fuel shut-off device according to the second embodiment.

As shown in FIG. 3, gasket 37 has flange portion 371 which is disposed on the lower end of cylindrical body 6 and sleeve portion 372 which is inserted into fuel passage 61. Restriction aperture 312 is formed at slide portion 31. For this purpose slide portion 31 has a cutout connecting restriction aperture 312 and fuel passage 61. Ball 38 is fixed or soldered to valve body 32 instead of tapered portion 321 of the first embodiment.

If the length of sleeve portion 372 is changed, the moving distance of piston 30 can be changed easily so that the maximum fuel to be supplied or the operation characteristics can be changed. If gasket 37 is fixed upside down, as shown in FIG. 4, the moving distance can be changed to L+H.

Figure 5:
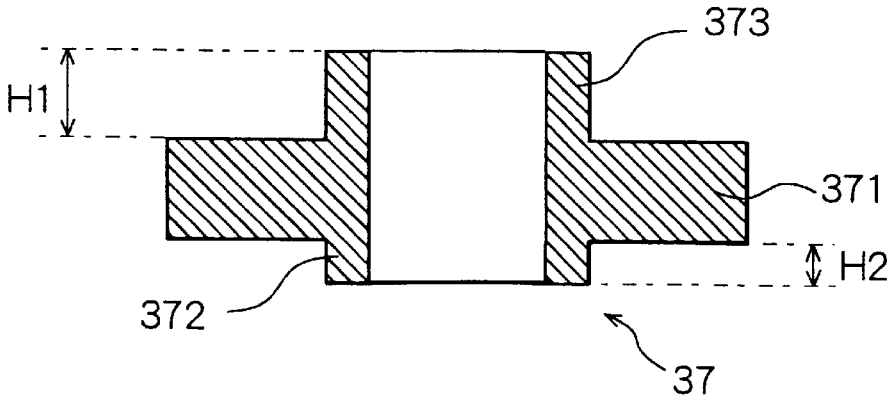
FIG. 5 is a cross-sectional side view of a variation of a gasket of the fuel shut-off device according to the second embodiment.

As a variation, gasket 37 can have sleeves 372 and 373 at opposite ends thereof, as shown in FIG. 5. Sleeve 373 has length H1 and sleeve 372 has length H2 for the same purpose as described above.

Fuel shut-off device 10 can be disposed between high pressure fuel pump 7 and pressure accumulation chamber 4.

In the foregoing description of the present invention, the invention has been disclosed with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than restrictive, sense.

What is claimed is:

1. A fuel shut-off device for an internal combustion engine comprising:

a cylindrical body having a fuel inlet, a fuel passage inside said cylindrical body, a fuel outlet, and a valve seat disposed between said fuel inlet and fuel outlet;

a piston having a slide portion disposed to slide in said fuel passage, a valve body integrated with said slide portion and extending axially therefrom to shut off said fuel passage when it is seated on said valve seat, a center bore connected to said fuel inlet, and a restriction aperture connecting said center bore and said fuel passage between said slide portion and said valve seat; and a biasing means, disposed between said slide portion and said valve seat, for biasing said piston to unseat said valve body from said valve seat, wherein said valve body has a cylindrical surface having an outside diameter smaller than said slide portion, said slide portion has a shoulder formed between said slide portion and said valve body to support an end of said coil spring around said valve body, and said restriction aperture is formed at said valve body.

2. The fuel shut-off device as claimed in claim 1, wherein said biasing means comprises a coil spring disposed around said valve body.

3. The fuel shut-off device as claimed in claim 1 further comprising a gasket having a flange portion in contact with said cylindrical body at said fuel inlet and two sleeve portions extending from said flange portion in the opposite directions so that one of said sleeve portions can be fitted in said fuel passage, wherein said one of said sleeve portions is different in length from the other.

4. The fuel shut-off device as claimed in claim 1, wherein said restriction aperture extends transversely in said valve body.

* * * * *